US006945811B2

(12) United States Patent
Feye-Hohmann

(10) Patent No.: US 6,945,811 B2
(45) Date of Patent: Sep. 20, 2005

(54) CLAMPING SPRING DEVICE FOR AN ELASTIC CLAMP

(75) Inventor: Juergen Feye-Hohmann, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 10/606,339

(22) Filed: Jun. 25, 2003

(65) Prior Publication Data

US 2004/0014353 A1 Jan. 22, 2004

(30) Foreign Application Priority Data

Jul. 17, 2002 (DE) ..... 102 32 256

(51) Int. Cl.[7] ..... H01R 4/24
(52) U.S. Cl. ..... 439/441
(58) Field of Search ..... 439/441, 835, 439/437–440, 418

(56) References Cited

U.S. PATENT DOCUMENTS 4,084,876 A * 4/1978 Dinger ..... 439/439
6,039,597 A * 3/2000 Getselis et al. ..... 439/441
6,146,217 A * 11/2000 Osada ..... 439/835
6,280,233 B1 8/2001 Beege et al. ..... 439/441
6,719,581 B2 * 4/2004 Kikuchi ..... 439/441

FOREIGN PATENT DOCUMENTS

DE 29915512 2/2001
JP 54053283 A * 4/1979 ..... H01R/9/12

* cited by examiner

*Primary Examiner*—Tho D. Ta
*Assistant Examiner*—Felix O. Figueroa
(74) *Attorney, Agent, or Firm*—Davidson, Davidson & Kappel, LLC

(57) ABSTRACT

A clamping spring device for an elastic clamp for attaching at least one electrical conductor includes a support and a clamping leg at an end of a spring leg. The support includes a freestanding edge. The clamping leg projects toward the support at an acute angle so as to form a receiving space between the clamping leg and the support. The receiving space narrows in a conductor insertion direction from a conductor insertion side toward a clamping point and is configured to receive the at least one electrical conductor inserted in a lengthwise direction. The clamping leg includes a clamping edge for clamping the electrical conductor between the clamping edge and the support at the clamping point. In the clamping position, the clamping leg is offset from the freestanding edge so that, when clamped, the at least one electrical conductor is bent around the freestanding edge, providing an interlocking effect.

7 Claims, 4 Drawing Sheets

CLAMPING SPRING DEVICE FOR AN ELASTIC CLAMP

Priority is claimed to German patent application DE 102 32 256.2, which is hereby incorporated by reference herein.

The present invention relates to a clamping spring device for an elastic clamp for attaching at least one electrical conductor in a receiving space.

BACKGROUND

An elastic clamp having a clamping spring device is known from German Utility Model Specification 299 15 512 U1. The interlocking of the clamped conductor is provided to prevent unintended withdrawal of the conductor from the clamping spring device and/or from the elastic clamp. In the known device, the interlocking of the clamped conductor is achieved solely in that the clamping leg on the spring leg is at an acute angle in relation to the support, viewed in the conductor insertion direction. In this way, the clamping edge on the clamping leg that is applied to the conductor is pressed against the conductor more strongly in the event of traction on the conductor against the conductor insertion direction, which is to cause the interlocking effect.

In the above known clamping spring device, the support, against which the clamping leg on the spring leg presses the clamped conductor, comprises a continuous flat surface. The clamped conductor accordingly does not experience deformation when it is pressed against the surface, due to which the conductor is secured against withdrawal solely by interlocking the conductor on the clamping edge of the clamping leg. Above all for a braided conductor, which comprises multiple thin conducting wires, the security against conductor withdrawal is not sufficient in the known clamping spring device, which is due to, among other things, not all of the conductor wires being able to be grasped by the clamping edge of the clamping leg and individual conductor wires being able to tear out if the conductor is pulled against the conductor insertion direction.

SUMMARY OF THE INVENTION

It is an object of the present invention to provide a clamping spring device for an elastic clamp with enhanced security against unintended conductor withdrawal.

The present invention provides a clamping spring device for an elastic clamp for attaching at least one electrical conductor (6), particularly a braided, flexible conductor, to a receiving space (5) assigned thereto, in which the conductor (6) may be inserted and clamped in its lengthwise direction between a clamping edge (4) on the face of a clamping leg (3) positioned on the end of a spring leg (2) and a support (1), the clamping leg (3) being directed toward the support (1) at an acute angle in such a way that the receiving space (5) between the clamping leg (3) and the support (1) narrows from the conductor insertion side toward the clamping point, and interlocking of the clamped conductor (6) also being provided in the region of this receiving space (5). The support (1) has a freestanding edge (7) on its side lying toward the clamping leg (3), which, viewed opposite the conductor insertion direction, is positioned in the clamping position at a distance from the clamping edge (4) of the clamping leg (3) applied to the conductor (6) such that the clamped conductor (6) is bent around the edge (7) of the support (1).

The bending of the conductor out of the conductor insertion direction is important for the present invention. "Bending" according to the present invention does not mean that the conductor is laid exactly on the contour of the freestanding edge of the support or the clamping edge of the clamping leg. Rather, bending according to the present invention is to be understood to mean that the conductor experiences bending or angling out of its otherwise straight course when the clamping edge of the clamping leg is applied to it at the clamping point and the deformation of the conductor caused in this way provides additional security against withdrawal. Because the conductor bends around both the freestanding support edge and the clamping edge of the clamping leg, interlocking of the clamped conductor results due to the resistance of the conductor metal against bending back. It is to be noted in this regard that the conductor inserted into the clamping spring device is only clamped and bent when a clamping leg, lifted off of the support by an auxiliary device, is released to spring back into its clamping position.

BRIEF DESCRIPTION OF THE DRAWINGS

The present invention is elaborated upon below based on exemplary embodiments, with reference to the drawings.

DETAILED DESCRIPTION

Figure 1:
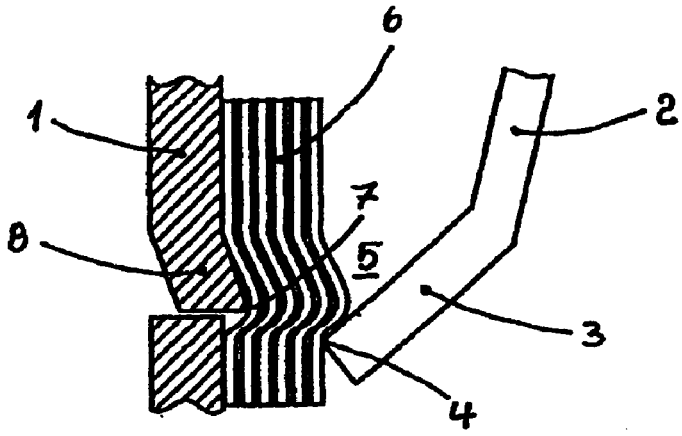
FIG. 1 shows a schematic, partially cutaway view of the clamping point of a clamping spring device for an elastic clamp having a support in a first embodiment.

In detail, FIG. 1 shows a support 1, on one side of which, the clamping side, a spring leg 2 is positioned. The spring leg 2 is supported in the relevant elastic clamp in a suitable way so that one free end of it may clamp against the support 1 in the form of a spring leaf. The spring leg 2 has a clamping leg 3 having a clamping edge 4 on its free end, which is directed toward the support 1 and is forced in the direction toward the support 1 under the spring force of the spring leg 2.

The clamping leg 3 on the spring leg 2 runs at an acute angle toward the support 1, which is implemented in a plate shape at least in the region opposite the clamping leg 3. In this way, an attachment space 5, which narrows toward the clamping point, is formed between the support 1 and the clamping leg 3, into which a spreader element (not shown in FIG. 1) may dip in order to lift the spring-loaded clamping leg 3 off of the support 1. This is used to insert an electric conductor 6, which is an easily flexible braid of multiple conducting wires. After the spring leg 2 and/or the clamping leg 3 is released by the spreader element described, the conductor 6, which is inserted between the support 1 and the clamping leg 3 in its lengthwise direction, is fixed on the clamping point due to angling and friction at the clamping edge 4 and the support 1.

When it is clamped, the conductor 6, which initially extends straight, is bent at the clamping point, which causes a permanent deformation of the conductor at the clamping point. In front of and behind the clamping point, the conductor 6 may extend further in the original straight direction as before, the deflection of the conductor 6 around an obstruction being important. This obstruction is formed by a freestanding edge 7 on the support 1, which, like the clamping edge 4 on the clamping leg 3, points in the direction opposite the conductor withdrawal direction. In addition, the edge on the otherwise flat side of the support 1 projects toward the clamping leg 3. Viewed in the conductor insertion direction, the freestanding edge 7 on the support 1 and the clamping edge 4 on the clamping leg 3 are offset from one another. The clamping edge 4 on the clamping leg 3 is behind the freestanding edge 7 of the support 1, viewed in the insertion direction of the conductor 6, so that a first angling of the conductor 6 out of its original direction occurs on the freestanding edge 7 of the support 1 and a further deflection of the conductor 6 in the opposite direction occurs on the clamping edge 4 of the clamping leg 3. In this way, the clamped conductor 6 is curved into a shape which, as a supplement to the friction lock provided, causes a form fit which is based on the residual rigidity of the conductor metal still existing in spite of the flexibility of the conductor.

In the exemplary embodiment shown in FIG. 1, the freestanding edge 7 is formed by a tongue 8 cut free on the support 1. The tongue 8 is simultaneously pressed slightly out of the plane of the support 1 in the direction toward the spring leg 2 and/or the clamping leg 3, in order to form the edge 7, located on the end of the tongue 8, which projects toward the clamping leg 3.

Figure 2:
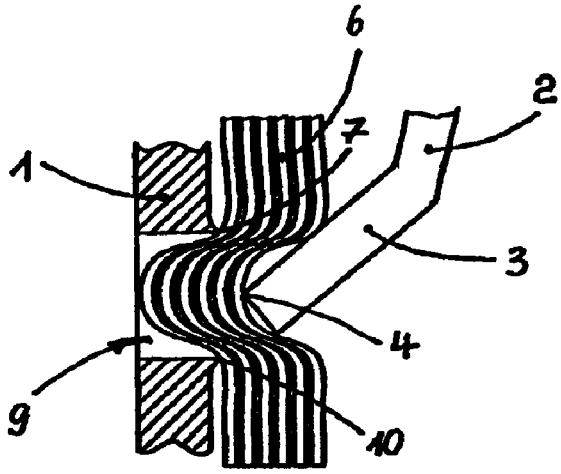
FIG. 2 shows an illustration corresponding to FIG. 1 of the clamping point of a clamping spring device having a support in a second embodiment.

In the exemplary embodiment shown in FIG. 2, the freestanding edge 7 of the support 1 is formed by the edge of a hole 9, which is arranged as a through hole in the support 1. In this case as well, the edge 7 points in the direction away from the conductor insertion side, in order to cause interlocking of the conductor 6, which is bent around it. The clamping edge 4 on the clamping leg 3 of the spring leg 2 is approximately at the height of the middle of the hole 9, viewed in the conductor insertion direction, through which a triple deflection is achieved for the conductor 6, which extends over the hole 9. The first deflection occurs at the hole edge, which forms the freestanding edge 7, the second at the clamping edge 4 of the clamping leg 3, and the third at the edge 10 lying opposite the edge 7, which thus also forms an edge which deflects the conductor 6. Viewed another way, the conductor 6 is bent by the clamping edge 4 of the clamping leg 3 into the hole 9, due to the force of the spring leg 2 in the clamping position. Thus, a first angle is achieved at the edge 7 and a second angle is achieved at the clamping edge 4 of the clamping leg 3 for the purpose of form-fitting interlocking.

Figure 3:
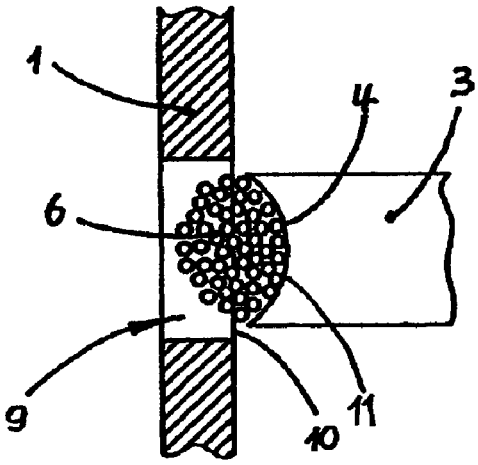
FIG. 3 shows a partially cutaway illustration of the top view of the clamping point shown in FIG. 2.

FIG. 3 illustrates that the clamping edge 4 at the side of the clamping leg 3 toward the support 1 has an indentation 11, which is formed by a concave rounding of the clamping edge 4. This shaping allows the conductor 6, which comprises multiple wires, to be bunched when the clamping edge 4 is applied to it, in order to thus avoid splitting of the conductor. For this purpose, the indentation 11 may also have another shape, in that it is implemented as a V-shape or in the form of a trapezoid.

Figure 4:
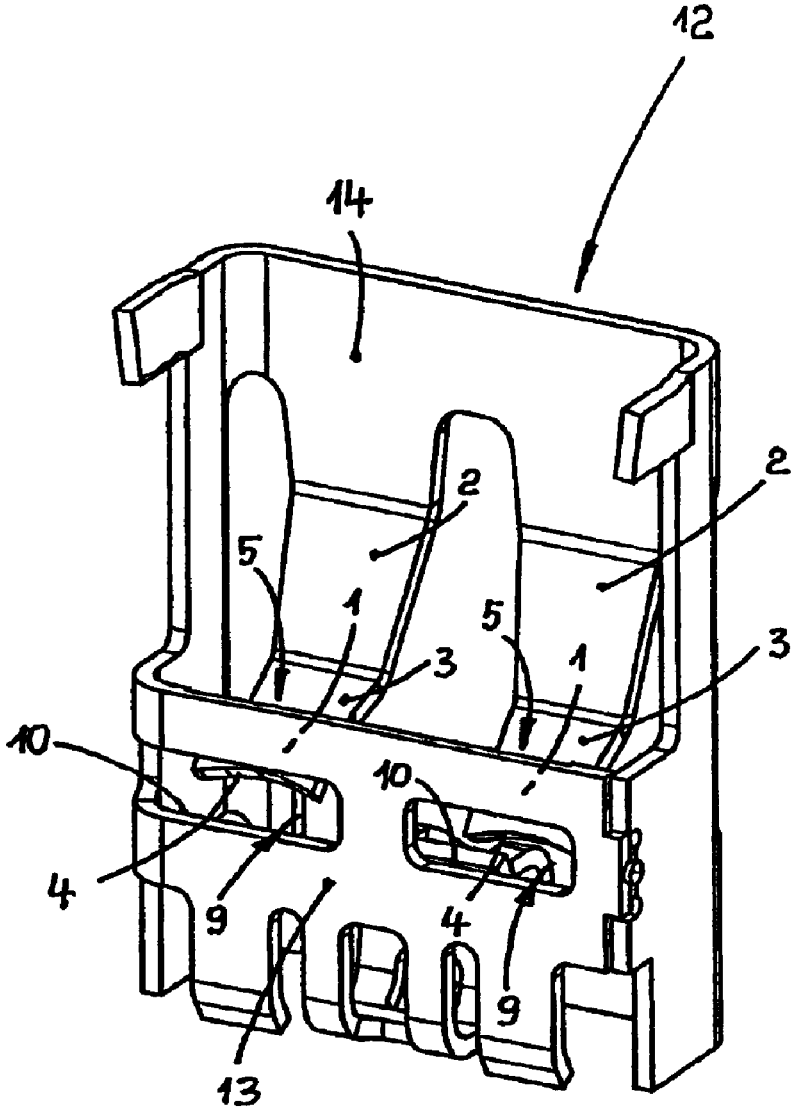
FIG. 4 shows a perspective illustration of the clamping device in a practical embodiment as shown in FIGS. 2 and 3 in the form of a box-type spring.
Figure 5:
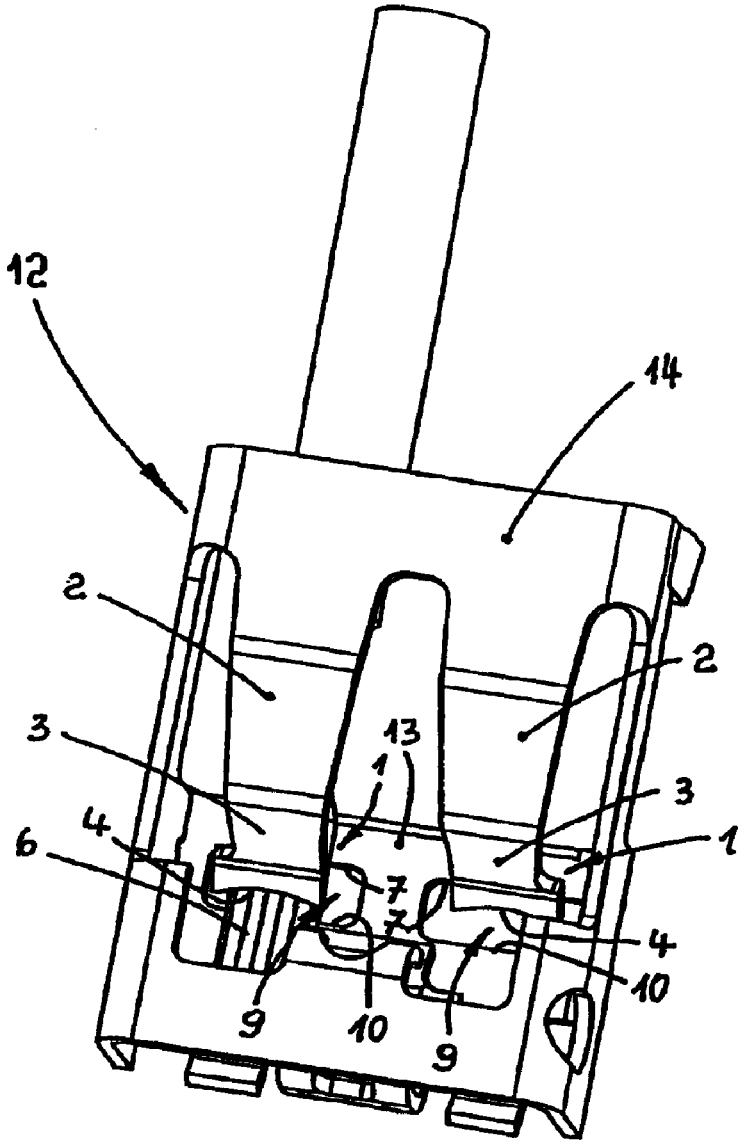
FIG. 5 shows a perspective rear view of the box-type spring shown in FIG. 4.
Figure 6:
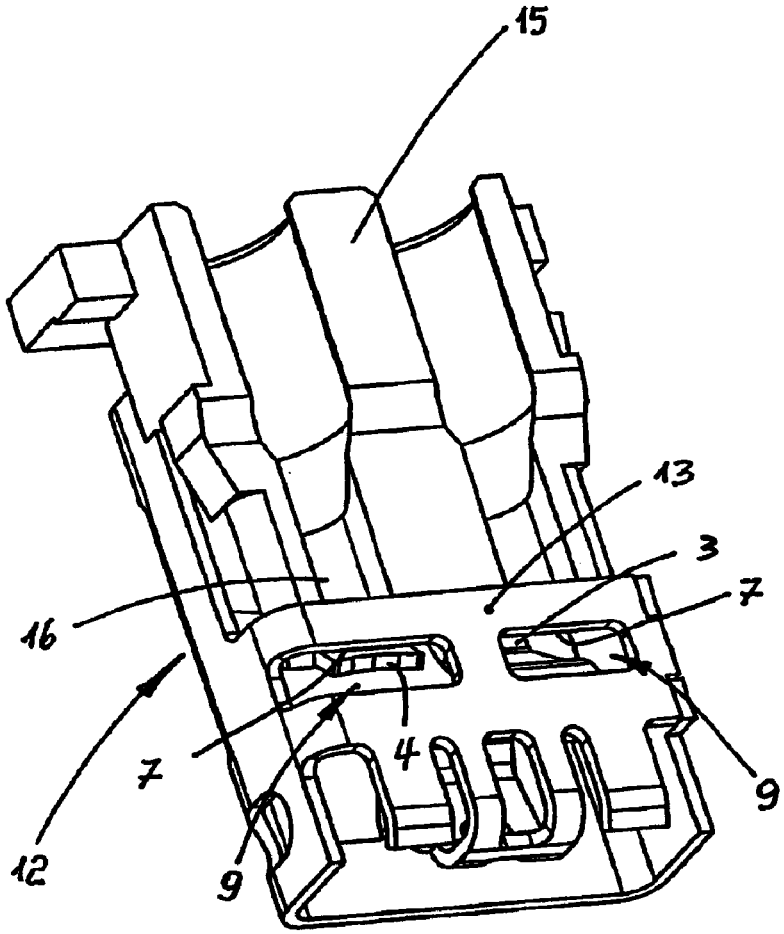
FIG. 6 shows a perspective front view of the box-type spring shown in FIGS. 4 and 5 with the pusher inserted.

FIGS. 4, 5, and 6 show a box-type spring 12 for an elastic clamp, which is equipped with two clamping spring devices of the type described in principle above. The box-type spring has a front wall 13 and a rear wall 14, whose main surfaces lie in planes parallel to one another. The inside of the front wall 13 forms the support 1 of the clamping spring devices and has two through holes 9, whose edges form the clamping edges 7 and 10 recognizable in FIG. 5.

Two spring legs 2 for each clamping spring device are cut free from the rear wall 14 of the box-type spring 12, which is made of metal. The clamping legs 3 on the ends thereof are angled toward the front wall 13 of the box-type spring 12.

The clamping edges 4 of the clamping legs 3 on the spring legs 2 lie at the height of the through holes 9 in the front wall 13 of the box-type spring 12. As may be seen in FIG. 5, the clamping leg 3 of the spring leg 2, illustrated on the right here, presses against the freestanding edge 7 formed by the edge of the relevant hole 9, without clamping a conductor. In order that an easily flexible conductor 6 may be inserted between the clamping edge 4 of the clamping leg 3 and the support 1 in the region of the hole 9, the clamping leg 3 is lifted off of the support 1—as already described. A pusher part 15, illustrated in FIG. 6, which is movable in the box-type spring 12, is used for this purpose. On the inner end, the pusher part 15 has spreader elements 16, which are forced like a wedge between the support 1 and the spring leg 2 and/or the clamping leg 3 located thereon when the pusher part 15 is operated and thus move the clamping leg 3 away from the support 1. Upon release, the pusher part 15 with its spreader elements 16 automatically moves back into its starting position due to the spring force of the spring leg 2, so that a conductor 6 inserted into the attachment space 5 between the support 1 and the clamping leg 3 is clamped in the way described above.

In FIG. 6, the clamping leg 3 on the right is shown in its position lifted off of the support 1 merely for illustration, although the pusher part 15 is not shown in its pressed-in position.

What is claimed is:

1. A clamping spring device for an elastic clamp for attaching at least one electrical conductor, comprising:

a support defining a hole, an edge of the hole forming a freestanding edge; and a clamping leg disposed at an end of a spring leg, the clamping leg projecting toward the support at an acute angle so as to form a receiving space between the clamping leg and the support, the receiving space narrowing in a conductor insertion direction from a conductor insertion side toward a clamping point and being configured to receive the at least one electrical conductor inserted in a lengthwise direction of the at least one electrical conductor, the clamping leg including a clamping edge on a face thereof so as to be capable of clamping the at least one electrical conductor between the clamping edge and the support at the clamping point in a clamping position;

wherein, in the clamping position, the clamping leg is offset from the freestanding edge in the conductor insertion direction so that, when clamped, the at least one electrical conductor is bent around the freestanding edge so as to provide an interlocking effect;

wherein a second edge of the hole opposite the freestanding edge forms a second freestanding edge, and wherein, in the clamping position, the clamping edge is aligned with a central portion of the hole so that, when clamped, the at least one electrical conductor is bent around the second freestanding edge.

2. The clamping spring device as recited in claim 1 wherein the freestanding edge projects toward the clamping leg.

3. The clamping spring device as recited in claim 1 wherein the support includes a tongue having a free end cut and bent out of a plane of the support, the freestanding edge projecting from the tongue.

4. The clamping spring device as recited in claim 1 wherein the clamping edge defines an indentation configured to partially encircle the at least one electrical conductor when clamped.

5. A clamping spring device for an elastic clamp for attaching at least one electrical conductor, comprising:

a support defining a hole, an edge of the hole forming a freestanding edge; and a clamping leg disposed at an end of a spring leg, the clamping leg projecting toward the support at an acute angle so as to form a receiving space between the clamping leg and the support, the receiving space narrowing in a conductor insertion direction from a conductor insertion side toward a clamping point and being configured to receive the at least one electrical conductor inserted in a lengthwise direction of the at least one electrical conductor, the clamping leg including a clamping edge on a face thereof so as to be capable of clamping the at least one electrical conductor between the clamping edge and the support at the clamping point in a clamping position;

wherein, in the clamping position, the clamping leg is offset from the freestanding edge in the conductor insertion direction so that, when clamped, the at least one electrical conductor is bent around the freestanding edge so as to provide an interlocking effect;

wherein a second edge of the hole opposite the freestanding edge forms a second freestanding edge, and wherein, in the clamping position, the clamping edge is aligned with the hole so that, when clamped, the at least one electrical conductor is bent around the second freestanding edge.

6. The clamping spring device as recited in claim 5 wherein the freestanding edge projects toward the clamping leg.

7. The clamping spring device as recited in claim 5 wherein the clamping edge defines an indentation configured to partially encircle the at least one electrical conductor when clamped.

* * * * *